US011146011B1

(12) United States Patent
Paige

(10) Patent No.: US 11,146,011 B1
(45) Date of Patent: Oct. 12, 2021

(54) ELECTRICAL OUTLET PLUG RETENTION DEVICE

(71) Applicant: Larry Paige, Darlington, SC (US)

(72) Inventor: Larry Paige, Darlington, SC (US)

( * ) Notice: Subject to any disclaimer, the term of this patent is extended or adjusted under 35 U.S.C. 154(b) by 0 days.

(21) Appl. No.: 17/015,163

(22) Filed: Sep. 9, 2020

(51) Int. Cl.
*H01R 13/426* (2006.01)
*H01R 13/639* (2006.01)

(52) U.S. Cl.
CPC ..... *H01R 13/426* (2013.01); *H01R 13/6395* (2013.01)

(58) Field of Classification Search
CPC ..... H01R 13/426; H01R 13/6395
See application file for complete search history.

(56) References Cited

U.S. PATENT DOCUMENTS 1,749,623 A * 3/1930 Zinman ..... H01R 13/6335 439/484
2,977,564 A * 3/1961 Gennaro ..... H01R 13/633 439/160
4,042,292 A * 8/1977 Chensky ..... H01R 13/633 439/160
4,210,377 A * 7/1980 La Voque ..... H01R 13/6335 439/484
4,293,173 A * 10/1981 Tricca ..... H01R 13/443 174/67
4,530,556 A * 7/1985 Bonus ..... H01R 13/6395 439/296
4,566,185 A * 1/1986 Bryan ..... H01R 13/6395 29/845
4,618,740 A * 10/1986 Ray ..... H01R 13/44 174/67
5,017,153 A * 5/1991 Bowman ..... H01R 13/453 439/135
5,026,300 A * 6/1991 Varner ..... H01R 13/6395 439/371
5,342,995 A * 8/1994 Comerci ..... H01R 13/447 174/67
5,516,305 A * 5/1996 Haluska ..... H01R 13/6335 439/476.1
RE40,600 E * 12/2008 Maltby ..... H02G 3/126 174/66
7,625,230 B2 * 12/2009 Boerner ..... H01R 13/6335 439/484

(Continued)

*Primary Examiner* — Ross N Gushi
(74) *Attorney, Agent, or Firm* — Gulf Coast Intellectual Property Group

(57) ABSTRACT

A device configured to be superposed an electrical receptacle that is operable to maintain the position of an electrical plug ensuing insertion into the electrical receptacle. The device includes a body wherein the body is planar in manner and mateably sized with an electrical outlet. The body has a first side and a second side with the second side having an adhesive disposed thereon. The body includes a first aperture, a second aperture and a third aperture. The first and second aperture are parallel each other and align with slots on the electrical receptacle. The third aperture aligns with the ground slot of the receptacle. A plurality of retention members are contiguously formed with the body and are formed in the three apertures. The plurality of retention members are independently movable and are bendable so as to engage the prongs of a plug and maintain the plug in the receptacle.

10 Claims, 1 Drawing Sheet

(56) References Cited

U.S. PATENT DOCUMENTS

| | | | | |
|---|---|---|---|---|
| 8,182,279 | B2 * | 5/2012 | Reusche | H01R 13/5219 439/271 |
| 9,054,455 | B2 * | 6/2015 | Llewellyn, III | H01R 13/6335 |
| 9,088,081 | B2 * | 7/2015 | Hildebrandt | H01R 13/521 |
| 9,711,900 | B1 * | 7/2017 | Brown | H01R 25/006 |
| 10,148,033 | B2 * | 12/2018 | Mortun | H01R 13/14 |
| 2013/0040495 | A1 * | 2/2013 | Moss | H01R 13/447 439/625 |
| 2017/0141510 | A1 * | 5/2017 | Lacey | H01R 13/5219 |

* cited by examiner

ELECTRICAL OUTLET PLUG RETENTION DEVICE

FIELD OF THE INVENTION

The present invention relates generally to electrical outlet accessories, more specifically but not by way of limitation, a device configured to provide retention of a plug subsequent being inserted into the receptacle of the electrical outlet so as to ensure maintenance of a proper operable coupling therewith.

BACKGROUND

As is known in the art, electrical outlets are mounted in all structures and are utilized to provide distribution of power. Thousands of devices run on electrical power or must be operably coupled thereto in order to provide charging of an onboard battery with devices such as but not limited to a cellular phone. Standard outlets in most residential homes are one hundred and twenty volt electrical receptacles. These receptacles are configured with three slots with two slots being parallel and a bottom slot being half-rounded and the latter being the ground with the upper two slots being the hot and the return. Disposed within the outlet slots are metal contacts that are operable to conduct the electricity to the plug ensuing engagement therewith. These metal contacts are biasly mounted utilizing a spring or other suitable element so as to ensure the metal contact engages with the plug not only for proper conducting of electricity but also to maintain the position of the plug in the receptacle.

As electrical outlets are utilized over a period of time, the metal contacts within the receptacles begin to lose the resiliency of their mounting. This typically results in two undesirable outcomes. One, the electrical connection may be insufficient between the plug and the contact plates and as such deliver intermittent conducting of electricity. Additionally, upon being inserted into the receptacle the plug can sag outward which further exacerbates the aforementioned problem. Many modern devices have a two prong plug with a low voltage adapter integrated into the plug. The combination of the absence of a ground and the increased size and weight of the plug leads to these types of plugs having difficulties properly functioning in older outlets. While replacement of the plug is required, those without electrical/mechanical capabilities are required to hire a professional electrician which can cost hundreds of dollars for a simple receptacle replacement.

It is intended within the scope of the present invention to provide a device that will assist in the retention of a plug ensuing being coupled to an electrical receptacle wherein the device of the present invention is configured to be superposed a conventional electrical receptacle.

SUMMARY OF THE INVENTION

It is the object of the present invention to provide a device configured to assist in the retention of an electrical plug in an electrical outlet receptacle wherein the device of the present invention has a body that is planar in manner.

Another object of the present invention is to provide an electrical plug retention device operable to ensure proper position of a plug in a fatigued electrical receptacle wherein the body includes a first side and a second side.

A further object of the present invention is to provide a device configured to assist in the retention of an electrical plug in an electrical outlet receptacle wherein the body has formed therein three apertures.

Still another object of the present invention is to provide an electrical plug retention device operable to ensure proper position of a plug in a fatigued electrical receptacle wherein the three apertures are configured to mateably superpose the three slots of a conventional electrical outlet receptacle.

An additional object of the present invention is to provide a device configured to assist in the retention of an electrical plug in an electrical outlet receptacle wherein the three apertures further have formed therein retention members.

Yet a further object of the present invention is to provide an electrical plug retention device operable to ensure proper position of a plug in a fatigued electrical receptacle wherein the retention members include lateral edge and are adjacent each other so as to substantially cover the openings of the three apertures.

Another object of the present invention is to a provide a device configured to assist in the retention of an electrical plug in an electrical outlet receptacle wherein the retention members are configured to engage a plug as the plug is inserted into the electrical receptacle and be biased inwards into the slots of the receptacle while maintaining engagement with the plug member.

An alternate object of the present invention is to provide an electrical plug retention device operable to ensure proper position of a plug in a fatigued electrical receptacle wherein the body is manufactured from plastic or other suitable non-conductive material.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
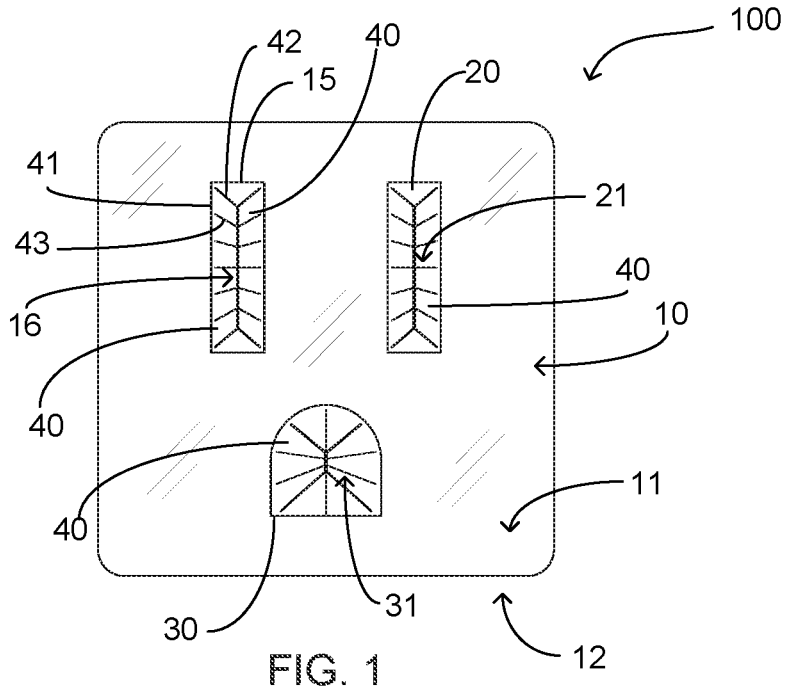
FIG. 1 is a front view of the preferred embodiment of the present invention.
Figure 2:
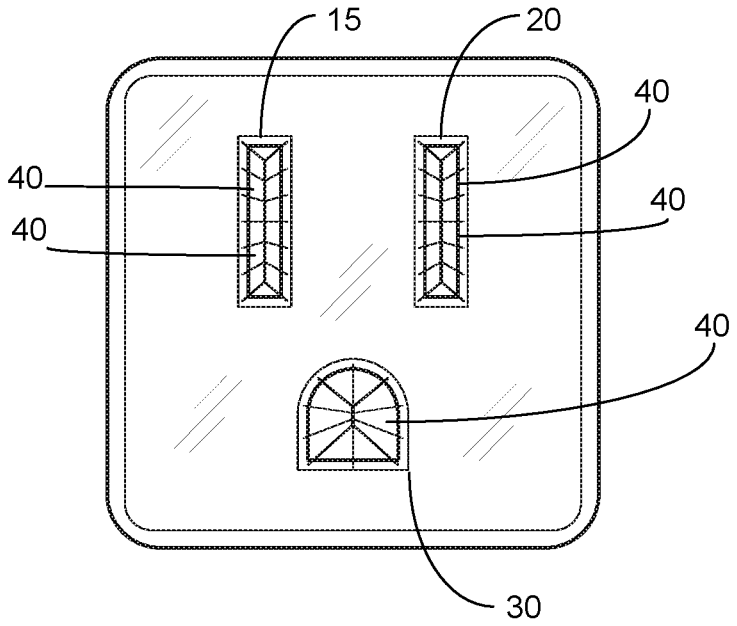
FIG. 2 is a front view of the preferred embodiment of the present invention superposed an electrical outlet receptacle.

Referring now to the drawings submitted herewith, wherein various elements depicted therein are not necessarily drawn to scale and wherein through the views and figures like elements are referenced with identical reference numerals, there is illustrated an electrical outlet plug retention device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted as a part hereof, the electrical outlet plug retention device 100 includes a body 10. The body 10 is planar in manner having a first side 11 and a second side 12. The body 10 is manufactured from a suitable non-conductive material such as but not limited to plastic. The body 10 is formed to be mateably shaped to a conventional receptacle on a standard electrical outlet. Disposed on the second side 12 of the body 10 is a pressure sensitive adhesive or other suitable material.

The body 10 includes a first aperture 15, a second aperture 20 and a third aperture 25 formed therein. The first aperture 15 and second aperture 20 are rectangular in shape and are parallel to each other. The first aperture 15 includes opening 16 and the second aperture 20 includes opening 21. The third aperture 25 further includes opening 31. The first aperture 15 and second aperture 20 are formed and position on the body 10 so as to align with the hot and neutral(return) slots formed in a standard one hundred and twenty volt electrical receptacle. The third aperture 30 is formed on the body 10 so as to align with the ground slot on the aforementioned electrical receptacle.

The first aperture 15, second aperture 20 and third aperture 30 have integrally formed therewith retention members 40. The retention members 40 are contiguously formed with the body 10 utilizing suitable durable techniques. The retention members 40 includes a rearward edge 41, opposing lateral edges 42, 43 and a forward edge. A plurality of retention member 40 are formed in the first aperture 15, second aperture 20 and third aperture 30. The plurality of retention members 40 are positioned so as to be adjacent each other wherein the lateral edges 42,43 of a first retention member 40 are bordering the lateral edges 42,43 of the neighboring retention member 40. The retention members 40 are configured to be bendable at the rearward edge 41 and separately movable in an inward direction towards the receptacle. Each of the retention members 40 is independently movable and is configured to be bent inwards towards the receptacle upon engagement with a plug. The retention members 40 function to bias against the sides of the prongs of a conventional electric plug and as such assist in the retention of an electrical plug ensuing being operably coupled into an electrical receptacle. Once a user has superposed a electrical outlet plug retention device 100 over a receptacle, the user will then insert a desired electrical plug thereinto and during the insertion process the retention members 40 will engage the sides of the prongs of the electrical plug and bend inwards towards the receptacle. The frictional engagement with the prongs of the electric plug assist in maintaining the electrical plug in an optimal position in the electrical receptacle.

While a plurality of retention members 40 have been illustrated herein, it is contemplated within the scope of the present invention that the electrical outlet plug retention device 100 could include as few as two retention members 40 per aperture wherein the retention members 40 in the immediately aforementioned configuration could be positioned on opposing sides of the prongs of the electrical plug. It should be further understood within the scope of the present invention that the body 10 could be provided in alternate thicknesses.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A device configured to be superposed an electrical receptacle and operable to engage an electrical plug during insertion into the electrical receptacle wherein the device comprises:

a body, said body being planar in manner, said body having a first side and a second side, said second side being adjacent the electrical receptacle subsequent being superposed thereon;

a first aperture and a second aperture, said first aperture and said second aperture being formed in said body, said first aperture and said second aperture being adjacent each other, said first aperture and said second aperture having an opening;

a third aperture, said third aperture being formed in said body, said third aperture being located below said first aperture and said second aperture on said body; and at least six retention members, said at least six retention members being formed in the first aperture, second aperture and third aperture, said at least six retention members being configured to be bendable, said at least six retention members configured to cover the openings of said first aperture, said aperture and third aperture, said at least six retention members operable to frictionally engage prongs of the electrical plug during insertion into the electrical receptacle so as to maintain the electrical plug in position ensuing insertion into the electrical plug.

2. The device configured to be superposed an electrical receptacle as recited in claim 1, wherein the at least six retention members include a rearward edge and opposing lateral edges.

3. The device configured to be superposed an electrical receptacle as recited in claim 2, wherein the first aperture and second aperture are rectangular in shape and parallel.

4. The device configured to be superposed an electrical receptacle as recited in claim 3, wherein the at least six retention members are configured to be bendable at said rearward edge thereof.

5. The device configured to be superposed an electrical receptacle as recited in claim 4, wherein said body is manufactured from plastic.

6. The device configured to be superposed an electrical receptacle as recited in claim 5, wherein the second side of said body further has an adhesive disposed thereon.

7. A device configured to be superposed an electrical receptacle wherein the device is operable to maintain an electrical plug ensuing being inserted into the electrical receptacle wherein the device comprises:

a body, said body being planar in manner, said body having a first side and a second side, said second side having an adhesive disposed thereon, said second side being adjacent the electrical receptacle subsequent being superposed thereon;

a first aperture and a second aperture, said first aperture and said second aperture being formed in said body, said first aperture and said second aperture being adjacent each other, said first aperture and said second aperture being rectangular in shape, said first aperture and said second aperture being parallel, said first aperture and said second aperture having an opening;

a third aperture, said third aperture being formed in said body, said third aperture being located below said first aperture and said second aperture on said body; and a plurality of retention members, said plurality of retention members being contiguously formed with said body, said plurality of retention members being formed in the first aperture, second aperture and third aperture, said plurality of retention members being configured to be independently movable, said plurality of retention members configured to cover the openings of said first aperture, said aperture and third aperture, said plurality of retention members having opposing lateral edges and a rearward edge, said plurality of retention members operable to frictionally engage prongs of the electrical plug during insertion into the electrical receptacle so as to maintain the electrical plug in position ensuing insertion into the electrical plug.

8. The device configured to be superposed an electrical receptacle as recited in claim 7, wherein said plurality of retention members are positioned so as to be adjacent each other wherein the opposing lateral edges of a first retention member 40 are bordering the opposing lateral edges of a neighboring retention member.

9. The device configured to be superposed an electrical receptacle as recited in claim 8, wherein said plurality of retention members are configured to be bendable at said rearward edge thereof.

10. The device configured to be superposed an electrical receptacle as recited in claim 9, wherein said body is manufactured from plastic.

* * * * *